US007253555B2

(12) United States Patent
Choi et al.

(10) Patent No.: US 7,253,555 B2
(45) Date of Patent: Aug. 7, 2007

(54) ELECTRODELESS LAMP SYSTEM AND BULB THEREOF

(75) Inventors: Joon-Sik Choi, Seoul (KR); Yong-Seog Jeon, Gyeonggi-Do (KR); Hyo-Sik Jeon, Gyeonggi-Do (KR); Hyun-Jung Kim, Seoul (KR); Ji-Young Lee, Gyeonggi-Do (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 71 days.

(21) Appl. No.: 10/338,725

(22) Filed: Jan. 9, 2003

(65) Prior Publication Data

US 2004/0080258 A1 Apr. 29, 2004

(30) Foreign Application Priority Data

Oct. 24, 2002 (KR) ..... 10-2002-0065349

(51) Int. Cl.
*H01J 1/62* (2006.01)
*H01J 5/02* (2006.01)
*H01J 61/30* (2006.01)

(52) U.S. Cl. ..... 313/161; 313/493; 313/153; 315/248

(58) Field of Classification Search ..... 313/493, 313/161, 607, 634, 234, 613, 571, 567, 637, 313/491, 162, 631, 153; 315/39, 248
See application file for complete search history.

(56) References Cited

U.S. PATENT DOCUMENTS 1,676,790 A * 7/1928 Mailey ..... 313/607
2,148,017 A * 2/1939 Germer ..... 313/34
3,943,401 A * 3/1976 Haugsjaa et al. ..... 315/39
4,038,578 A * 7/1977 Mathijssen ..... 313/623
4,480,213 A * 10/1984 Lapatovich et al. ..... 315/248
4,864,194 A * 9/1989 Kobayashi et al. ..... 315/248
5,384,515 A * 1/1995 Head et al. ..... 313/607
5,923,116 A * 7/1999 Mercer et al. ..... 313/113
5,965,976 A * 10/1999 Khan et al. ..... 313/493
6,016,031 A * 1/2000 Lapatovich et al. ..... 313/493
6,072,268 A 6/2000 Dolan et al.
6,465,955 B1 * 10/2002 Kraus et al. ..... 313/567
6,486,603 B1 * 11/2002 Ikeuchi et al. ..... 313/639
6,661,174 B2 * 12/2003 Eastlund et al. ..... 313/634
2002/0180356 A1 * 12/2002 Kirkpatrick et al. ..... 313/607

FOREIGN PATENT DOCUMENTS

| | | | |
|---|---|---|---|
| DE | 39 18 839 A1 | | 12/1989 |
| EP | 0 458 544 A | | 11/1991 |
| EP | 0 602 746 A | | 6/1994 |
| JP | 57-152663 A | | 9/1982 |
| JP | 58-005960 A | | 1/1983 |
| JP | 2-079354 | | 3/1990 |
| JP | 05347143 A | * | 12/1993 |
| JP | 6-260274 A | | 9/1994 |
| JP | 2001-250512 A | | 9/2001 |
| WO | WO-97/27617 A | | 7/1997 |

* cited by examiner

*Primary Examiner*—Karabi Guharay
(74) *Attorney, Agent, or Firm*—Birch, Stewart, Kolasch & Birch, LLP

(57) ABSTRACT

A bulb in an electrodeless lamp system comprises a bulb unit having an envelope space in which luminous material excited by an electric field to form plasma and generate light is filled and two or more conductors installed in the envelope space so that ends of the conductors face each other.

29 Claims, 4 Drawing Sheets

ELECTRODELESS LAMP SYSTEM AND BULB THEREOF

BACKGROUND OF THE INVENTION

1. Field of the Invention

The present invention relates to an electrodeless lamp system, and particularly, to a bulb used in an electrodeless lamp system.

2. Description of the Background Art

An electrodeless lamp system is a device for lighting by forming an electric field using microwave in a bulb unit in which a luminous material which illuminates by forming plasma due to the electric field.

Generally, when the electrodeless lamp is turned off, the electrodeless lamp system can be re-lighted after a certain time (tens of seconds~a few minutes) has passed, since a mean free path of an electron having energy for forming plasma is not ensured due to high pressure of neutral gas, that is, the buffer gas filled together with the luminous material in the bulb unit.

In a case in which Xenon Xe is used as the buffer gas, light efficiency is improved about 5% more than in a case in which Argon Ar gas is used. However, a collision cross-section of Xe is large, and therefore, it is difficult to discharge in a high pressure state.

Therefore, in the conventional art, in order to reduce the re-lighting time of the electrodeless lamp system, a strong wind is blown directly to the bulb unit to cool down the bulb and to decrease the pressure in the bulb unit, however, problems such as increased cost due to additional devices, reliability of the additional devices, utilization of a space around the bulb unit, and light screening by the additional devices are generated.

Also, in a case of a light source of small size, that is, in a case of the bulb unit for a point light source (an arc gap is less than 2 mm), there should be an auxiliary device for initial light emitting.

SUMMARY OF THE INVENTION

Therefore, an object of the present invention is to provide an electrodeless lamp system and a bulb thereof by which re-lighting can be done easily and a size of a bulb unit can be reduced greatly.

To achieve the object of the present invention, as embodied and broadly described herein, there is provided a bulb of an electrodeless lamp system comprising: a bulb unit having an envelope space in which luminous material excited by an electric field to form plasma and to generate light is filled; and two or more conductors installed in the envelope space and disposed to face end portions of each other.

Also, to achieve the object of the invention, there is provided an electrodeless lamp system comprising: a microwave generator for generating microwaves; a resonator connected to the microwave generator to resonate the microwave generated in the microwave generator; a bulb unit having an envelope space in which luminous material which is excited by an electric field to form plasma is filled in order to generate light, installed in the resonator; and two or more conductors installed in the envelope space and disposed to face end portions of each other.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
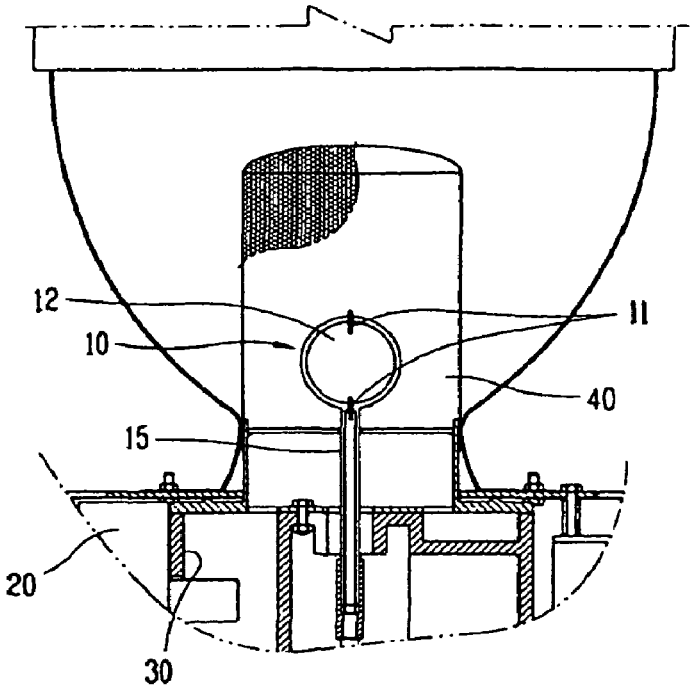
FIG. 1 is a partial cross-sectional view showing a part of an electrodeless lamp system according to the present invention.

As shown in FIG. 1, an electrodeless lamp system according to the present invention comprises: a microwave generator 20 for generating microwaves; a resonator 40 connected to the microwave generator 20 to resonate the microwave generated in the microwave generator 20; a bulb unit 10 having an envelope space, in which luminous material excited by an electric field formed in the resonator 40 to form plasma and to generate light is filled, installed in the resonator 40; and two conductors 11 installed in the envelope space 12 so that end portions face each other.

The microwave generator 20 is a device for generating microwave forming an electric field, by which the luminous material is able to form the plasma, and a magnetron is used as the microwave generator generally.

In addition, the microwave generator 20 can be installed with the resonator 40 or additionally, and the microwave generator 20 can be connected to the resonator 40 by a waveguide 30 in order to transmit microwaves generated from the microwave generator 20 to the resonator 40.

The luminous material may be metal, a halogen compound, sulfur or selenium (Se) which is able to generate light such as visible ray (wavelength of the generated light can be varied according to the luminous material). In addition, buffer gas comprising Ar, Xe, Kr, etc. for initial lighting, and discharge catalyst material such as mercury for helping the initial discharging to make the lighting easy or controlling characteristics of the generated light are filled with the luminous material.

A sealed envelope space 12 is formed in the bulb unit 10, and the bulb unit 10 is made with material having a high light transmittance and little dielectric loss such as quartz or light transmissive ceramic. In addition, when the size of the sealed envelope space 12 is small, as in the bulb unit for a point light source, it is desirable that a thickness of the bulb unit 10 is larger than twice a width of the envelope space 12 in order to improve easiness in fabrication and the reliability of the bulb unit 12.

The bulb unit 10 is installed in the resonator 40, and may be installed by a supporting member 15 as shown in FIG. 1.

Figure 2:
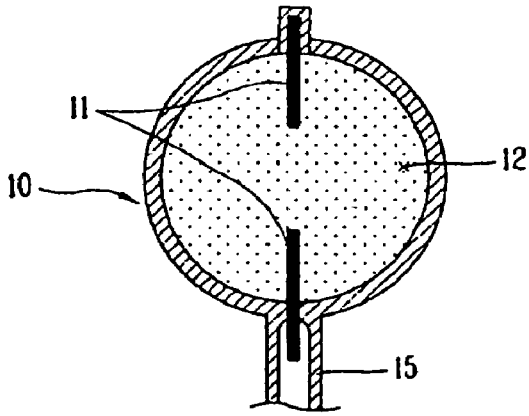
FIG. 2 is a cross-sectional view showing the first embodiment of the electrodeless lamp system shown in FIG. 1.
Figure 3:
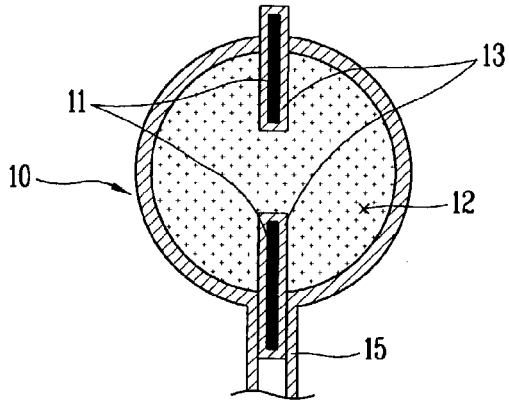
FIG. 3 is a cross-sectional view showing the conductor coated with heat-resisting member in the bulb unit shown in FIG. 2.

Two (or more) conductors 11 may be installed, and the ends of the conductors are disposed to face each other so that a strong electric field is formed between the ends of the conductors as shown in FIG. 2. The conductors 11 are made of material such as tungsten having a high heat resistance so that the physical shape of the conductors can be maintained even in high temperatures of hundreds of degrees centigrade in the envelope space 12. In addition, as shown in FIG. 3, the conductors 11 may be coated with a heat-resisting member 13 on outer circumferential surfaces thereof so as to prevent the conductors from being deteriorated by directly reacting with the luminous material in the envelope space 12. The heat-resisting member 13 may be same material as the bulb unit 10 such as the quartz or the light transmissive ceramic, when considering the junction with the bulb unit 10 and the coefficient of thermal expansion, and the heat-resisting member 13 may be formed with marginal space considering the thermal expansion of the conductors 11.

Figure 5:
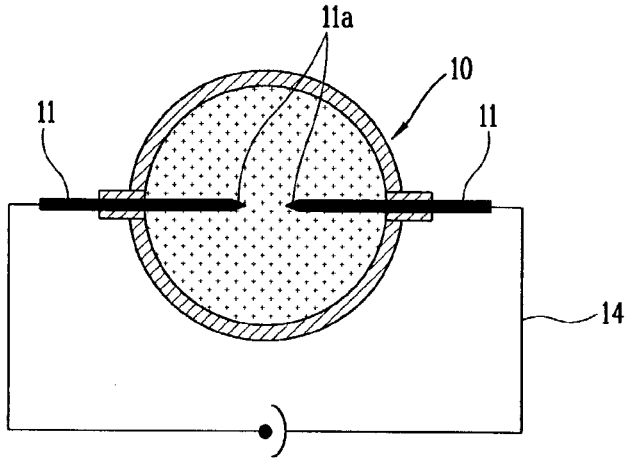
FIG. 5 is a cross-sectional view showing the second embodiment of the bulb unit in the electrodeless lamp system according to the present invention.
Figure 6:
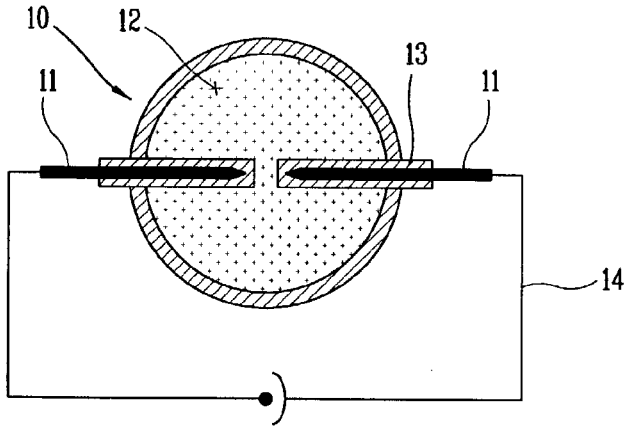
FIG. 6 is a cross-sectional view showing the bulb unit shown in FIG. 5 coated with a heat-resisting member.

On the other hand, the conductors 11 are able to concentrate the electric field more effectively according to the shapes of the bulb unit 10 or the conductors 11. In order to maximize the concentration of the electric field as shown in FIG. 5, a spire 11*a* may be formed on the end of the conductor 11 (shown in FIGS. 2 and 3). Of course, the heat-resisting member 13 may be coated on the conductor 11 as shown in FIG. 6.

Figure 7:
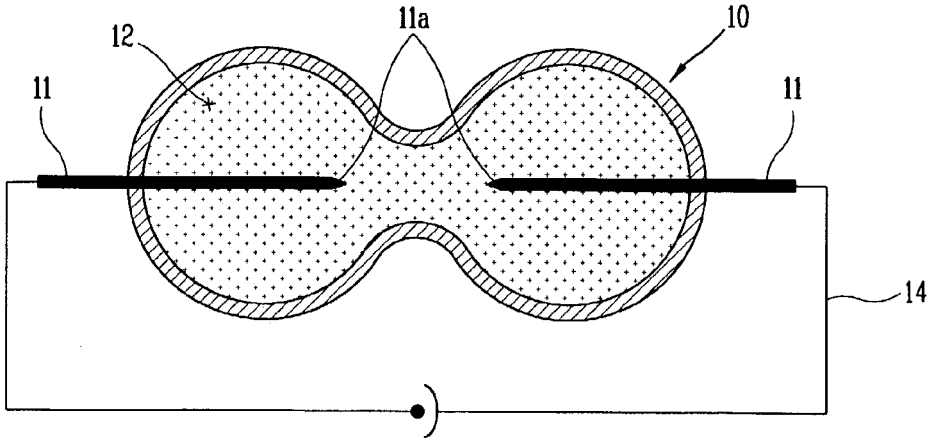
FIG. 7 is a cross-sectional view showing the third embodiment of the bulb unit in the electrodeless lamp system according to the present invention.
Figure 8:
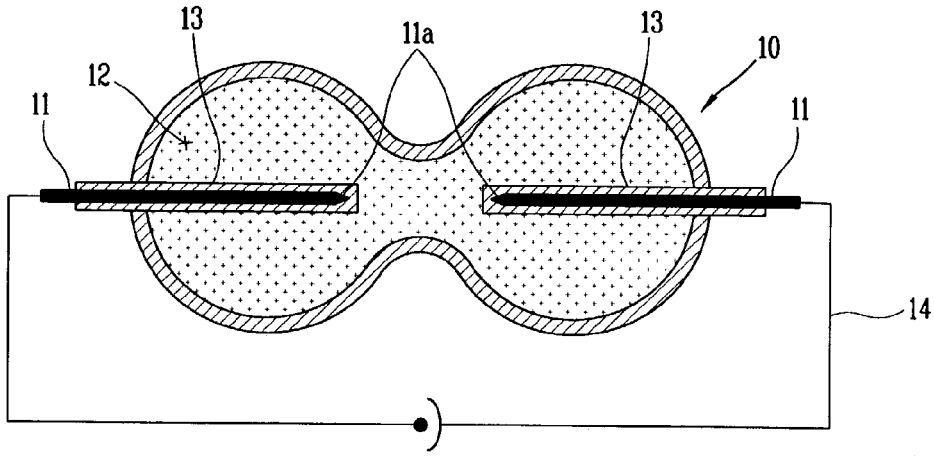
FIG. 8 is a cross-sectional view showing the bulb unit in FIG. 7 coated with a heat-resisting member.

Also, the shape of the bulb unit 10 may be changed in order to improve the concentration of the electric field in the envelope space 12, and the shape of the bulb unit 10 can be formed as an '8' shape as shown in FIGS. 7 and 8, not as a general spherical or circular shape. In addition, the ends of the conductors 11 are installed on both sides taking a curved part of the envelope space 12 therebetween, and thereby, the part where the electric field is concentrated is narrowed to generate a plasma concentration phenomenon, and the re-lighting is accelerated and the size of light source can be controlled.

Also, the bulb unit 10 having an '8' shape is able to control the gap between the conductors 11, and control the shape of the envelope space 12.

Figure 9:
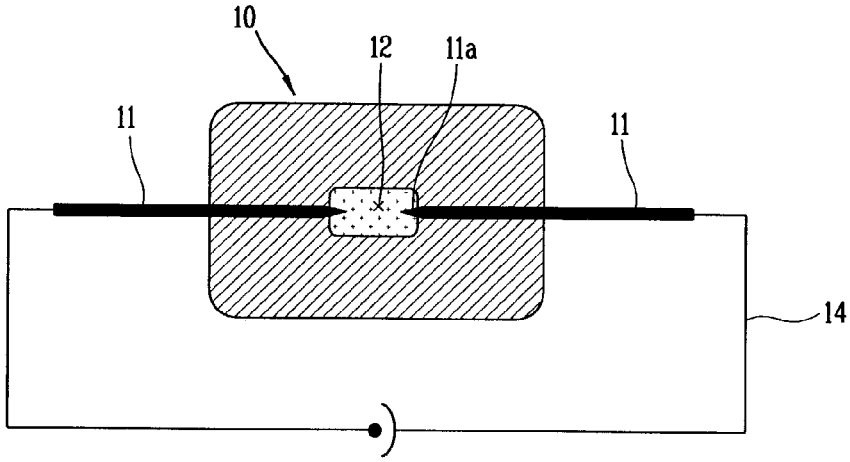
FIGS. 9 and 10 are cross-sectional views showing fourth and fifth embodiments of the bulb unit in the electrodeless lamp system according to the present invention.
Figure 10:
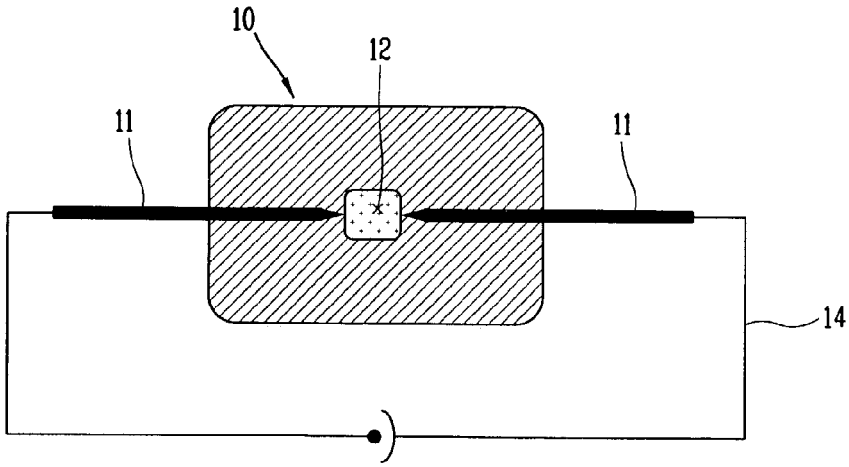

As shown in FIGS. 9 and 10, the distance between the ends of the conductors 11 is in proportion to the size of the envelope space 12, and therefore, the re-lighting characteristic according to the size change of bulb unit 10 can be improved. In a case of a light source of a small size, that is, the bulb unit for a point light source (an arc gap is less than 2 mm), the re-lighting characteristic can be improved by reducing the distance between the ends.

That is, as shown in FIGS. 9 and 10, the distance between the ends of the conductors 11 is in proportion to the size of the bulb unit 10 or the size of the envelope space 12, and therefore, an appropriate electric field concentration phenomenon can be generated for initial lighting or for re-lighting. As shown in FIG. 10, the conductors 11 can be installed in the bulb unit 10 without using the additional heat-resisting member 13 for protecting the conductors 11.

Figure 4:
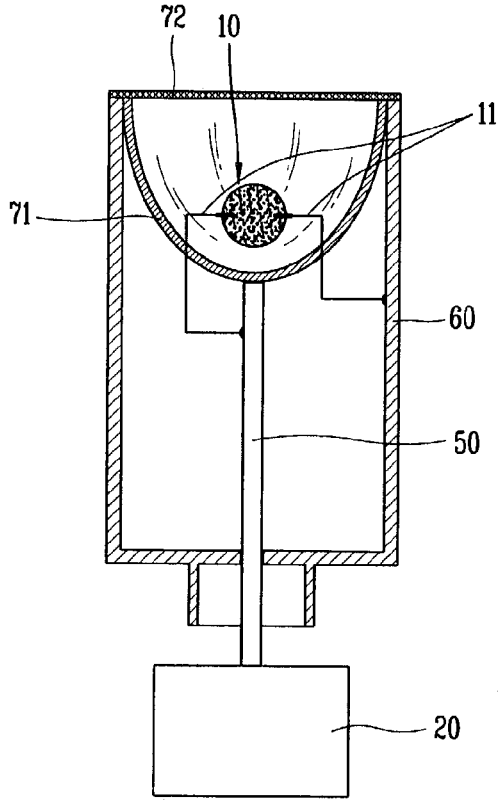
FIG. 4 is a cross-sectional view showing a resonator of coaxial type in the bulb unit used in the electrodeless lamp system according to the present invention.

On the other hand, as shown in FIG. 4, the electrodeless lamp system according to the present invention may include a microwave feeder unit 50 which is connected to the microwave generator 20 and extended into the resonator 60 for transmitting the microwave generated in the microwave generator 20 into the resonator 60. At that time, one of the conductors 11 is connected to the microwave feeder unit 50, and the other may be connected to the resonator 60.

Reference numeral 71 represents a reflecting mirror for making the light generated from the bulb unit 10 face toward a certain direction, and reference numeral 72 represents a mesh member which transmits the light and blocks the microwave. In addition, as shown in FIGS. 5 through 10, the parts 14 connected to the conductors 11 represent status that the conductors 11 are connected to the resonator 60 and to the microwave feeder unit 50 respectively, in case that the bulb unit 10 is used in the electrodeless lamp system shown in FIG. 4.

Operations of the electrodeless lamp system according to the present invention having the above structure will be described in detail as follows.

The microwave generator 20 generates the microwave having an output set by an electric power supply, and the generated microwave is transmitted into the resonator 40 by the waveguide 30. In addition, the luminous material filled in the envelope space 12 of the bulb unit 10 forms plasma by the electric field formed in the resonator 40, and thereby light is generated.

At that time, the buffer gas makes the initial lighting or the re-lighting of the bulb unit 10 easy, and at the same time, the strong electric field is concentrated between the conductors 11 to make the initial lighting or the re-lighting easy.

Also, in the electrodeless lamp system having the structure shown in FIG. 4, the strong electric field is formed between the resonator 60 and the microwave feeder unit 50. Moreover, the conductors 11 connected to the microwave feeder unit 50 and to the resonator 60 form the strong electric field together, and thereby, the initial lighting or re-lighting can be made easily.

According to the electrodeless lamp system of the present invention, the conductors facing each other are installed in the bulb unit to make the electric field concentrate on the ends of the conductors, and accordingly, the strong electric field is formed and the discharge speed of the electrons is accelerated. Thereby, the initial lighting time or the re-lighting time of the electrodeless lamp system can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A bulb for an electrodeless lamp system comprising:

a bulb unit, the bulb unit including an envelope and a supporting member for supporting the envelope, the envelope and the supporting member being a one-piece, unitary structure, the envelope defining an envelope space therein, luminous material in the envelope space being excited by an electric field to form plasma and generate light is filled, the supporting member defining a cavity space therein, the envelope having a partition separating the envelope space from the cavity space; and two or more conductors installed in the envelope space, each of the conductors having two ends, each one of the two ends of the conductors facing each other, one of the conductors passing through the envelope space and the partition into the cavity space, the one of the two ends of the one of the conductors terminating in the envelope space, the other of the two ends of the one of the conductors terminating in the cavity space.

2. The bulb of claim 1, wherein the bulb unit is quartz or light transmissive ceramic material.

3. The bulb of claim 1, wherein the number of the conductors are two.

4. The bulb of claim 1, wherein the conductors are made of tungsten.

5. The bulb of claim 1, wherein the conductors are coated with a heat-resisting member.

6. The bulb of claim 5, wherein the heat resisting member is the same material as that of the bulb unit.

7. The bulb of claim 1, wherein a distance between the ends of the conductors is in proportion to a size of the envelope space.

8. The bulb of claim 1, wherein a thickness of the bulb unit is larger than twice a width of the envelope space.

9. The bulb of claim 1, wherein the bulb unit is a spherical shape.

10. The bulb of claim 1, wherein the envelope has an outermost contour and an innermost contour, the outermost contour of the envelope has an '8' shape.

11. The bulb of claim 10, wherein the envelope space formed by the innermost contour of the envelope has an "8" shape.

12. The bulb of claim 11, wherein the envelope has a substantially same thickness throughout.

13. The bulb of claim 1, wherein the electrodeless lamp system uses a resonator of a coaxial type, one of the conductors are connected to the resonator, and the other is connected to an inner electrode which secures the bulb unit in the resonator.

14. The bulb of claim 1, wherein the supporting member is a tube.

15. The bulb of claim 1, wherein the envelope including the partition and the supporting member are a one-piece, unitary structure.

16. An electrodeless lamp system comprising:

a microwave generator for generating microwaves;

a resonator connected to the microwave generator for resonating the microwave generated from the microwave generator;

a bulb unit installed in the resonator, the bulb unit including an envelope and a supporting member for supporting the envelope, the envelope and the supporting member being a one-piece, unitary structure, the envelope defining an envelope space therein, luminous material in the envelope space forming plasma by an electric field formed in the resonator to generate light is filled, the supporting member defining a cavity space therein, the envelope having a partition separating the envelope space from the cavity space; and two or more conductors installed in the envelope space, each of the conductors having two ends, each one of the two ends of the conductors facing each other one of the conductors passing through the envelope space and the partition into the cavity space, the one of the two ends of the one of the conductors terminating in the envelope space, the other of the two ends of the one of the conductors terminating in the cavity space.

17. The system of claim 16, further comprising a waveguide connected to the microwave generator for transmitting the microwave from the microwave generator to the microwave.

18. The system of claim 16, wherein the number of the conductors are two.

19. The system of claim 16, the conductors are coated with a heat resisting material.

20. The system of claim 19, wherein the heat resisting member is the same material as that of the bulb unit.

21. The system of claim 19, wherein the heat resisting member is quartz or light transmissive ceramic material.

22. The system of claim 16, wherein a distance between the ends of the conductors is in proportion to a size of the envelope space.

23. The system of claim 16, wherein a thickness of the bulb unit is larger than twice a width of the envelope space.

24. The system of claim 16, comprising a microwave feeder unit connected to the microwave unit and extended into the resonator for transmitting the microwave generated in the microwave generator into the resonator, wherein one of the conductors is connected to the resonator and the other is connected to the microwave feeder unit.

25. The system of claim 16, wherein the supporting member is a tube.

26. The system of claim 16, wherein the envelope including the partition and the supporting member are a one-piece, unitary structure.

27. A bulb for an electrodeless lamp system comprising:

a bulb unit having an envelope space in which luminous material excited by an electric field to form plasma and generate light is filled; and two or more conductors installed in the envelope space so that ends of the conductors face each other, the electrodeless lamp system using a resonator of a coaxial type, one of the conductors being connected to the resonator, and the other being connected to an inner electrode which secures the bulb unit in the resonator.

28. An electrodeless lamp system comprising:

a microwave generator for generating microwaves;

a resonator connected to the microwave generator for resonating the microwave generated from the microwave generator;

a bulb unit installed in the resonator and having an envelope space in which luminous material forming plasma by an electric field formed in the resonator to generate light is filled;

two or more conductors installed in the envelope space so that ends of the conductors face each other; and a microwave feeder unit connected to the microwave unit and extended into the resonator for transmitting the microwave generated in the microwave generator into the resonator, wherein one of the conductors is connected to the resonator and the other is connected to the microwave feeder unit.

29. A bulb for an electrodeless lamp system comprising:

a bulb unit having an envelope space in which luminous material excited by an electric field to form plasma and generate light is filled; and two conductors located outside the envelope space, each of the conductors having a spire end facing each other, a width of the envelope space in a direction defined by the spire ends of the conductors being less than or equal to a distance between the spire ends of the conductors.

* * * * *